United States Patent [19]

Irwin

[11] 4,417,952

[45] Nov. 29, 1983

[54] APPARATUS FOR CLEANING COKE OVEN DOORS

[75] Inventor: Rodney C. Irwin, Monroeville, Pa.

[73] Assignee: Koppers Company, Inc., Pittsburgh, Pa.

[21] Appl. No.: 334,967

[22] Filed: Dec. 28, 1981

[51] Int. Cl.[3] ..... C10B 25/06; C10B 43/04

[52] U.S. Cl. ..... 202/241; 15/93 A

[58] Field of Search ..... 202/241; 201/2; 15/93 A

[56] References Cited

U.S. PATENT DOCUMENTS

| | | | |
|---|---|---|---|
| 3,621,506 | 11/1971 | Armstrong et al. | 202/241 |
| 3,741,806 | 6/1973 | Stanke et al. | 202/241 |
| 3,990,948 | 11/1976 | Lindgren | 202/241 |
| 4,243,490 | 1/1981 | Tsuzuki et al. | 15/93 A |
| 4,259,760 | 4/1981 | Harris | 202/241 |

FOREIGN PATENT DOCUMENTS

| | | | |
|---|---|---|---|
| 2384837 | 11/1978 | France | 202/241 |
| 542759 | 1/1974 | U.S.S.R. | 15/93 A |

*Primary Examiner*—Bradley Garris

*Attorney, Agent, or Firm*—Daniel J. Long; Herbert J. Zeh, Jr.; Oscar B. Brumback

[57] ABSTRACT

An apparatus for cleaning the top or bottom horizontal section of a coke oven door seal ring and which applies approximately constant pressure to all points along its lateral path. A cleaning head is pivotally mounted on the terminal end of an arm member which is, itself, pivotally mounted to oscillate in a horizontal arc on a base structure. An extension of the door cleaner frame is suspended above the arm and on this frame there is mounted a spring. A vertical, spring driven link is attached at its upper terminal end to this spring and at its lower end to the base. This link is also medially attached to the frame so as to pivot in a vertical arc about this point of attachment. A second idler link which is pivotally connected at its top to the frame and at its bottom to the pivoting base keeps the cleaning head from being vertically displaced out of contact with the seal ring.

7 Claims, 3 Drawing Figures

APPARATUS FOR CLEANING COKE OVEN DOORS

BACKGROUND OF THE INVENTION

1. Field of the Invention

The present invention deals with coke ovens and, in particular, with devices for cleaning coke oven doors.

2. Description of the Prior Art

Coke ovens are generally equipped at their ends with refractory lined doors which are removeable to allow a charge to be pushed from the oven on completion of the coking process. These doors have a peripheral metal seal ring which has a laterally extending body portion and an inwardly flanged knife edge which abuts the coke oven door jamb to form a gas tight seal between the door and the oven. While it is essential that this seal be maintained to prevent the escape of pollutants from inside the oven, it is found that a viscous, tarry distillation product of the coking operation, as well as a certain amount of a hard carbonaceous deposit, may tend to accumulate on this peripheral seal ring and disturb the seal. In order to ensure the maintenance of a positive seal, it is necessary that these deposits be periodically removed.

Various coke oven door cleaning devices are known in the art. In particular, certain devices are adapted for cleaning the refractory lining of the door and other devices are adapted for the right and left, vertical sections of the seal ring while still other devices are used on the top and bottom, horizontal sections. U.S. Pat. No. 4,259,760, for example, discloses a door cleaner for the top and bottom horizontal sections of the seal ring. This device includes a cleaning head having a number of angled side by side chisel-like blades, the end sections of which are fixed to a pivoting member so that these blades can traverse an arcuate path from the bottom or the top side of the seal ring to its side section. This device also includes a carriage for transporting the cleaning head in a reciprocal back and forth motion along the top or the bottom of the seal ring. This carriage is pivotally attached to the cleaning head and it includes a drive means to move it back and forth on slides or rollers in a path parallel to the door. Additionally, this device is equipped with a supporting ram which is fixed to the carriage on the side opposite from the cleaning head so as to move the carriage and the cleaning head toward and away from the surface to be cleaned. While the above described device has been found to effectively clean coke oven door seal rings, it does require relatively careful cleaning and maintenance since the large amount of dirt and dust found in the vicinity of coke ovens might tend to cause failures in one or more of the several moving parts found on this device. It is therefore the object of the present invention to provide a reliable, easily maintained device which effectively cleans coke oven seal rings and, in particular, the top and bottom, hroizontal sections of such seal rings.

SUMMARY OF THE INVENTION

The present invention is a cleaning device for a top or bottom horizontal section of a coke oven seal ring. It includes a lower base section having a central upwardly projecting pin and an arm member with a cleaning head on its terminal end. The arm member pivots on the pin so as to move the cleaning head from one side to the other on the horizontal section of the seal ring. Preferably, a hydraulic piston and cylinder combination mounted on the lower base section is connected to the arm member and is expanded and compressed to pivot the arm on the vertical pin. A supporting frame structure is suspended over the arm, and on this frame there is mounted a spring or another hydraulic cylinder. Attached to this spring there is a vertically disposed link which is also pivotally connected to the frame structure and the lower base structure. A second link is pivotally attached to both the frame and base structure to prevent the cleaning head from being displaced vertically as a result of the motion of the first link. Thus, as the arm is pivoted on the base structure the combined action of the above described spring and linkage will cause the cleaning head to be applied against all points along the horizontal section of the seal ring with approximately uniform pressure. Due to the small number of moving parts present in this device, it is easily maintained and well suited for use in a coke oven environment.

BRIEF DESCRIPTION OF THE DRAWINGS

The present invention is further described in the following drawings in which.

DETAILED DESCRIPTION

Figure 1:
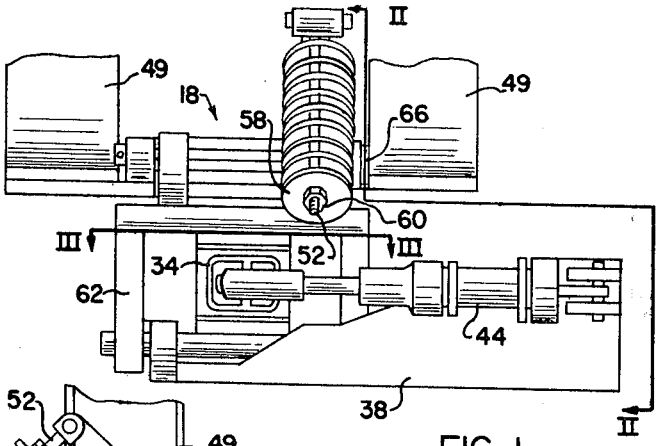
FIG. 1 is a front elevational view of a coke oven door cleaner representing one embodiment of the present invention.
Figure 2:
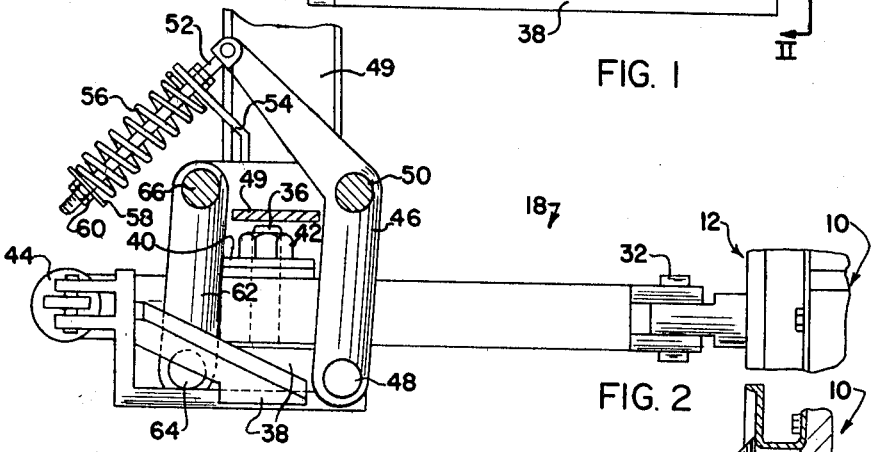
FIG. 2 is a side view partially in section along line II—II of FIG. 1 of the coke oven door cleaner of the present invention.
Figure 3:
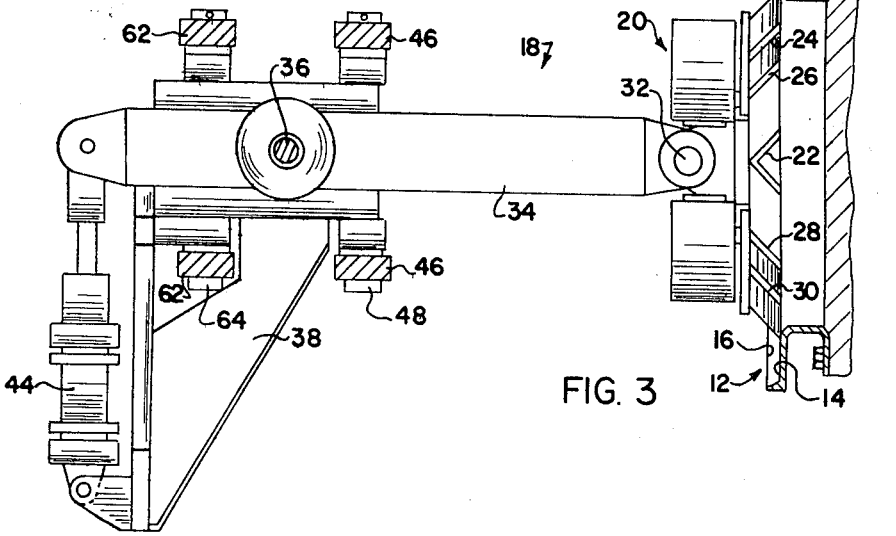
FIG. 3 is a plan view also partially in section along line III—III in FIG. 1 of the coke oven door cleaner of the present invention.

Referring to the drawings, a coke oven door is shown, in fragment, generally at numeral 10. Along the periphery of this door there is a seal ring, shown generally at number 12. This seal ring forms a gas tight seal with the oven door jamb to prevent the escape of volatile products of the coking process from the oven. The seal ring also has a planar surface 14 (FIG. 3) and a knife edge surface 16 (FIG. 3) which must be cleaned of carbonaceous material at the end of each coking cycle to ensure the maintenance of a gas tight seal between the seal ring and the door jamb. It is also noted that while the ring seal is a continuous peripheral structure on the oven door, it may be considered to include four separate sections. Above and below. the coke oven door refractory plug (not shown) there are horizontal sections. From both ends of the bottom horizontal section the seal ring curves upwardly and outwardly in an arcuate path to form right and left vertical seal ring sections which, themselves, extend upwardly then curve upwardly and inwardly to join, endwise, the top horizontal section. the purpose of the device of the present invention is to clean the top and bottom horizontal sections of the seal ring. In the drawings it is shown in use on a bottom horizontal section of a seal ring.

The coke oven door cleaner of the present invention, shown generally at numeral 18, includes a cleaning head 20 which is equipped with a plurality of chisel-like blades 22, 24, 26, 28 and 30. The outward blades 24, 26, 28 and 30 are pivotally attached to the head so as to permit the head to traverse the arcuate path of the sealing ring where its top or bottom, horizontal sections join its vertical side sections. Preferably the pivotable blades are constrained by a torsional spring and stop arrangement which is illustrated in detail in U.S. Pat. No. 4,259,760, the contents of which are incorporated by reference herein. This arrangement would allow the pivotable blades, once they have been turned to traverse a curved surface, to return to their initial position when the cleaning head is removed to a linear path.

Still referring to the drawings, it will be seen that the cleaning head 20 is attached by a pin 32 to a support arm 34. The support arm 34 is pivotally mounted on another pin 36 which extends upwardly from a pivot support base 38. It will also be seen that the arm 34 is retained on the pin 36 by means of washer 40 and nut 42. Connected to the rearward end of the arm 34 is a hydraulic piston and cylinder combination 44 which is also attached to the pivot support base 38 and which is expanded and compressed by means well known in the art to cause the arm 34 to pivot on pin 36 in a horizontal arc to move the cleaning head 20 from one side to the other of the bottom horizontal section of the seal ring 12 so as to remove carbonaceous material therefrom. It will, thus, be observed that the cleaning head 20 would, except for certain features of the present invention described below, be pressed against the seal ring with greater force at various points along its path than at other points. In order to compensate for such a difference in force otherwise resulting from the arcuate motion of the pivoting arm 34 on the pin 36, there is provided a spring driven link 46 which is pivotally connected to base 38 by pin 48. Above the arm 34 there is a door machine frame extension 49 to which spring driven link is pivotally connected by pin 50. Spring driven link 46 extends upwardly from its intermediate connection with pin 50 to a point where it is perpendicularly connected to a threaded rod 52 which is slideably retained on the frame extension 49 by a frame extension plate 54. Concentrically surrounding and longitudinally aligned with the rod 52 is a spring 56 which is retained on said rod by a spring retaining plate 58 and a spring tension adjusting nut 60. A second hydraulic piston and cylinder combination may be substituted for the spring 56. It will also be observed that a second idler link 62 is pivotally connected to both the base 38 and the frame extension 49 by pins 64 and 66. Thus, as the arm 34 is pivoted on pin 36 to move the cleaning head 20 across the horizontal section of the seal ring 12, the spring driven link 46 will be pivoted in a vertical arc about pin 50 so as to cause the spring 56 to be compressed or expanded so that the pressure which the cleaning head exerts against the seal ring is approximately equal at all points along the seal ring. The idler link 62 will serve to keep the cleaning head from being displaced vertically.

It will, therefore, be appreciated that there has been described a device for cleaning the top and bottom section of a coke oven door seal ring which effectively removes carbonaceous deposits from the planar and knife edge surfaces of those sections and which also requires less maintenance than most devices heretofore used for such purposes. Although the invention has been described with a certain degree of particularity, it is to be understood that the present disclosure has been made only as an example and that the scope of the invention is defined by what is hereafter claimed.

What is claimed is:

1. A device for cleaning a horizontal section of a coke oven door seal ring, said horizontal section having a vertical planar surface and a knife edge surface, comprising:

(a) a lower base structure having a central upwardly projecting pin;

(b) an arm member pivotally fixed on said upwardly projecting pin so as to oscillate thereon through a horizontal arc;

(c) a cleaning head member engageable with said seal ring and pivotally connected to the terminal end of said arm member so as to be pivotable thereon in a second horizontal arc and said cleaning head member having an elongated body portion that holds a plurality of longitudinally angled chisel-like blades for contacting the seal ring vertical planar surface, said blades forming an acute angle in scraping relationship with said vertical planar surface;

(d) means for pivoting the arm member on said upwardly projecting pin;

(e) a supporting frame structure suspended over the arm member and having a compressible means for resisting and exerting force along its longitudinal axis attached thereto at a point above said arm member;

(f) a vertical idler link pivotally connected at its upper end to said supporting frame structure and at its lower end to said base structure; and (g) a second vertical link connected at its upper end to said compressible means for resisting and exerting force along its longitudinal axis and at its lower end to said base structure and medially and pivotally connected to said frame structure, such that as the cleaning head is moved from a central position on the horizontal section of the seal ring by oscillation of the arm member on the upwardly projecting pin of said lower base structure, the second vertical link will be pivoted to move the lower base structure toward said horizontal section, and as the cleaning head member is returned to said central position by oscillation of the arm member the second vertical link will be pivoted to move the lower base structure away from said horizontal section so that the cleaning head member will bear against the vertical planar surface of the horizontal section of the seal ring with approximately constant pressure as it is displaced from side to side thereon.

2. The device as defined in claim 1 wherein the cleaning head member includes an end blade which pivots around a curved surface of the seal ring to follow and clean said curved surface, pivotal means to allow said end blade to pivot from a linear position around said curved surface and back, and means for returning said pivoted end blade from the curved surface to a linear position.

3. The device as defined in claim 2 wherein the cleaning head member comprises a center pair of rigidly fixed blades, and a pivotable pair of blades at each end of the cleaning head member which pivotable blades are constrained by a torsional spring and a stop, said torsional spring comprising said means for returning said pivotal end blades from the curved surface to the linear position, and affixed to said pivotable blades and a non rotating member of said head member, and said stop affixed to said head member in the path of movement of said pivotable blades.

4. The device as defined in claim 1 wherein the compressible means for resisting and exerting force along its longitudinal axis is a spring.

5. The device as defined in claim 1 wherein the compressible means for resisting and exerting force along its longitudinal axis is a hydraulic piston and cylinder combination.

6. The device as defined in claim 1 wherein the means for pivoting the arm member is a hydraulic piston and cylinder combination which is attached at its one end to said arm member and at its other end to said base structure.

7. The device as defined in claim 1 wherein the second vertical link has upper and lower sections adjoining one another at an obtuse angle.

* * * * *